US009235165B2

(12) United States Patent
Makino

(10) Patent No.: US 9,235,165 B2
(45) Date of Patent: Jan. 12, 2016

(54) IMAGE FORMING APPARATUS WITH ELECTROSTATIC CLEANING MEMBERS

(71) Applicant: CANON KABUSHIKI KAISHA, Tokyo (JP)

(72) Inventor: Masahiro Makino, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 113 days.

(21) Appl. No.: 13/870,298

(22) Filed: Apr. 25, 2013

(65) Prior Publication Data

US 2013/0287421 A1 Oct. 31, 2013

(30) Foreign Application Priority Data

Apr. 27, 2012 (JP) ..... 2012-102998

(51) Int. Cl.
*G03G 15/16* (2006.01)

(52) U.S. Cl.
CPC ..... *G03G 15/1675* (2013.01); *G03G 15/161* (2013.01)

(58) Field of Classification Search
CPC ..... G03G 15/1675
USPC ..... 399/66, 101, 313, 314
See application file for complete search history.

(56) References Cited

U.S. PATENT DOCUMENTS

2008/0181636 A1* 7/2008 Izumi ..... 399/44

FOREIGN PATENT DOCUMENTS

JP 2000-330401 A 11/2000
JP 2009258541 A * 11/2009
JP 2011-248128 A 12/2011
JP 2012073391 A * 4/2012

OTHER PUBLICATIONS

Machine translation of JP2009-258541.*
Machine translation of JP2012-073391.*

* cited by examiner

*Primary Examiner* — David Gray
*Assistant Examiner* — Andrew V Do
(74) *Attorney, Agent, or Firm* — Fitzpatrick, Cella, Harper & Scinto

(57) ABSTRACT

An image forming apparatus includes: an image bearing member; a transfer portion; a first electrostatic cleaning portion including a first electroconductive member; a second electrostatic cleaning portion including a second electroconductive member; a first detecting portion for outputting first information corresponding to a first current passing through the first electroconductive member; a second detecting portion for outputting second information corresponding to a second current passing through the second electroconductive member; and a controller for controlling, based on the first information and the second information, a transfer voltage so that the voltage is decreased when a decrease amount of the first current is larger than that of the second current and so that the voltage is increased when the decrease amount of the second current is larger than that of the first current.

10 Claims, 4 Drawing Sheets

IMAGE FORMING APPARATUS WITH ELECTROSTATIC CLEANING MEMBERS

FIELD OF THE INVENTION AND RELATED ART

The present invention relates to an image forming apparatus for removing a transfer residual toner remaining on an image bearing member in a downstream side of the transfer portion by electrostatic cleaning, and specifically relates to control in which electrical information obtained with the electrostatic cleaning of the image bearing member is fed back to a transfer voltage to be applied to the transfer portion.

The image forming apparatus in which a toner image formed on the image bearing member (photosensitive member or intermediary transfer member) is electrically transferred onto a transfer material (intermediary transfer member or recording material) and then the recording material on which the toner image is transferred is finally heated and pressed by a fixing device to fix the toner image on the recording material has been widely used. In Japanese Laid-Open Patent Application (JP-A) 2011-248128, an image forming apparatus in which the transfer residual toner is somewhat deposited on a surface of the image bearing member passed through the transfer portion and therefore an electrostatic cleaning device is provided downstream of the transfer portion so as to collect the transfer residual toner is disclosed.

In JP-A 2000-330401, an image forming apparatus in which the transfer voltage applied to the transfer portion is adjusted in general at the time of start of image formation so that a proper transfer current passes through the transfer portion and then constant current control or constant voltage control is effected is disclosed. However, when the transfer current is out of a proper range due to an environment condition, toner deterioration, a variation of the recording material, and the like, a transfer efficiency is lowered and thus a quality of an output image is lowered. Therefore, after the start of the image formation, the transfer voltage applied to the transfer portion is adjusted again.

In JP-A 2000-330401, at the transfer portion where a transfer roller is contacted to the image bearing member, before the start of the image formation, voltages at a plurality of levels are applied to the transfer roller to measure a voltage-current characteristic from which a reference voltage at which a predetermined transfer current flows in a state in which there is no recording material. Then, during the image formation, a constant voltage is obtained by adding a recording material sharing voltage, set in advance for every type of the recording material, to the reference voltage. However, there is also the case where the recording material sharing voltage set in advance is improper, and therefore in the case where a current passing through the transfer roller is detected after the image formation and is out of a tolerable range of the predetermined transfer current, correction such that the constant voltage is increased or decreased by a certain voltage level is made.

The transfer efficiency of the toner is compositely influenced by various factors as described above, and therefore in the control of JP-A 2000-330401, the predetermined transfer current itself does not always provide a peak of the transfer efficiency. For this reason, there is a possibility that the transfer efficiency is rather lowered and thus the output image quality is lowered by making the current, passing through the transfer roller in a state in which the toner image is transferred onto the recording material, equal to the predetermined transfer current.

However, a constitution in which the transfer current is changed at a plurality of levels and patch images are formed on actual recording materials to measure image density, and from a measurement result, the transfer current providing the peak of the transfer efficiency is obtained and then the predetermined transfer current is corrected before image formation takes excessive time, thus being not practical.

Incidentally, the transfer efficiency $\eta$ is a proportion $\nu=M1/M0$, i.e., the proportion of an amount M1 of the toner transferred from the image bearing member onto the recording material (or the intermediary transfer member) to a total amount M0 of the toner of the toner image carried on the image bearing member. Accordingly, when an amount M2 ($=M0-M1$) of a transfer residual toner which passed through the transfer portion and which remains on the image bearing member can be measured, it is possible to determine the transfer efficiency $\eta=(M0-M2)/M0$ without forming the patch image on the recording material. Further, without obtaining the transfer efficiency, the transfer voltage at which the amount of the transfer residual toner is minimum provides the peak of the transfer efficiency.

SUMMARY OF THE INVENTION

A principal object of the present invention is to provide an image forming apparatus capable of stably keeping a transfer efficiency at a high level by discriminating whether or not a transfer voltage with respect to a transfer residual toner, as an object to be measured, on an image bearing member is proper and then by optimizing the transfer voltage during image formation in real time.

According to an aspect of the present invention, there is provided an image forming apparatus comprising: an image bearing member; a transfer portion for transferring a toner image from the image bearing member onto a transfer material by being supplied with a voltage; a first electrostatic cleaning portion for bringing a first electroconductive member, supplied with a voltage of an identical polarity to a toner charge polarity, into contact with a surface of the image bearing member to collect a transfer residual toner passed through the transfer portion; a second electrostatic cleaning portion for bringing a second electroconductive member, supplied with a voltage of an opposite polarity to the toner charge polarity, into contact with the surface of the image bearing member to collect the transfer residual toner passed through the transfer portion; first detecting means for outputting first information corresponding to a current passing through the first electroconductive member; second detecting means for outputting second information corresponding to a current passing through the second electroconductive member; and control means for controlling, on the basis of the first information and the second information, the voltage applied to the transfer portion so that the voltage is decreased when a decrease amount of the current passing through the first electroconductive member is larger than that of the current passing through the second electroconductive member and so that the voltage is increased when the decrease amount of the current passing through the second electroconductive member is larger than that of the current passing through the first electroconductive member.

In the image forming apparatus of the present invention, by using a phenomenon that a balance of a charge polarity of a transfer residual toner is different between before and after a peak of the transfer efficiency, whether the transfer efficiency provided at a current transfer voltage is before or after the peak is discriminated. Then, on the basis of a discrimination result, the transfer voltage is corrected in real time, so that the transfer efficiency of the toner image at the transfer portion is brought near to its peak.

That is, in a voltage range lower than the transfer voltage at which the transfer efficiency shows its peak, most of the transfer residual toner is electrically charged to the identical polarity to the toner charge polarity, and therefore the transfer residual toner is caught by the second electroconductive member to which the constant voltage of the opposite polarity is applied, so that a contact resistance of the second electroconductive member is increased. On the other hand, in a voltage range higher than the transfer voltage at which the transfer efficiency shows its peak, the transfer residual toner electrically charged to the opposite polarity becomes dominant, and therefore the transfer residual toner is caught by the first electroconductive member to which the constant voltage of the identical polarity is applied, so that the contact resistance of the first electroconductive member is increased. Then, the contact resistances of the first and second electroconductive members cause a change in current passing through the first and second electroconductive member.

Therefore, by measuring the currents passing through the first and second electroconductive members, whether a current transfer voltage is higher or lower than the transfer voltage providing the peak transfer efficiency at the transfer portion can be accurately discriminated in real time, so that the transfer voltage can be adjusted. Properness of the transfer voltage is discriminated with respect to the transfer residual toner, as the measuring object, on the image bearing member, and then the transfer voltage during the image formation is optimized in real time, whereby the transfer efficiency can be maintained stably at a high level.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments of the present invention will be described in detail with reference to the drawings. The present invention can be carried out also in other embodiments in which a part or all of constitutions of the respective embodiments are replaced by their alternative constitutions so long as a voltage (current) applied to a transfer portion is adjusted depending on a polarity balance of a transfer residual toner on an image bearing member.

Accordingly, the image bearing member includes not only a photosensitive member but also an intermediary transfer member, a recording material conveying member, and a transfer belt. An electrode member (electroconductive member) contacted to the image bearing member is not limited to the far brush but may include a magnetic brush, a plate-like electrode, a metal roller and an electroconductive rubber roller.

The image forming apparatus of the present invention can be carried out irrespective of type of, full-color/monochromatic, one-drum/tandem, recording material transfer/intermediary transfer, image bearing member, charging, exposure, transfer fixing, and the like.

In the following embodiments, only a principal portion concerning formation/transfer of the toner image will be described but the present invention can be carried out in image forming apparatuses for various uses including printers, various printing machines, copying machines, facsimile machines, multi-function machines, and so on by adding necessary equipment, options, or casing structures.

<Image Forming Apparatus>

Figure 1:
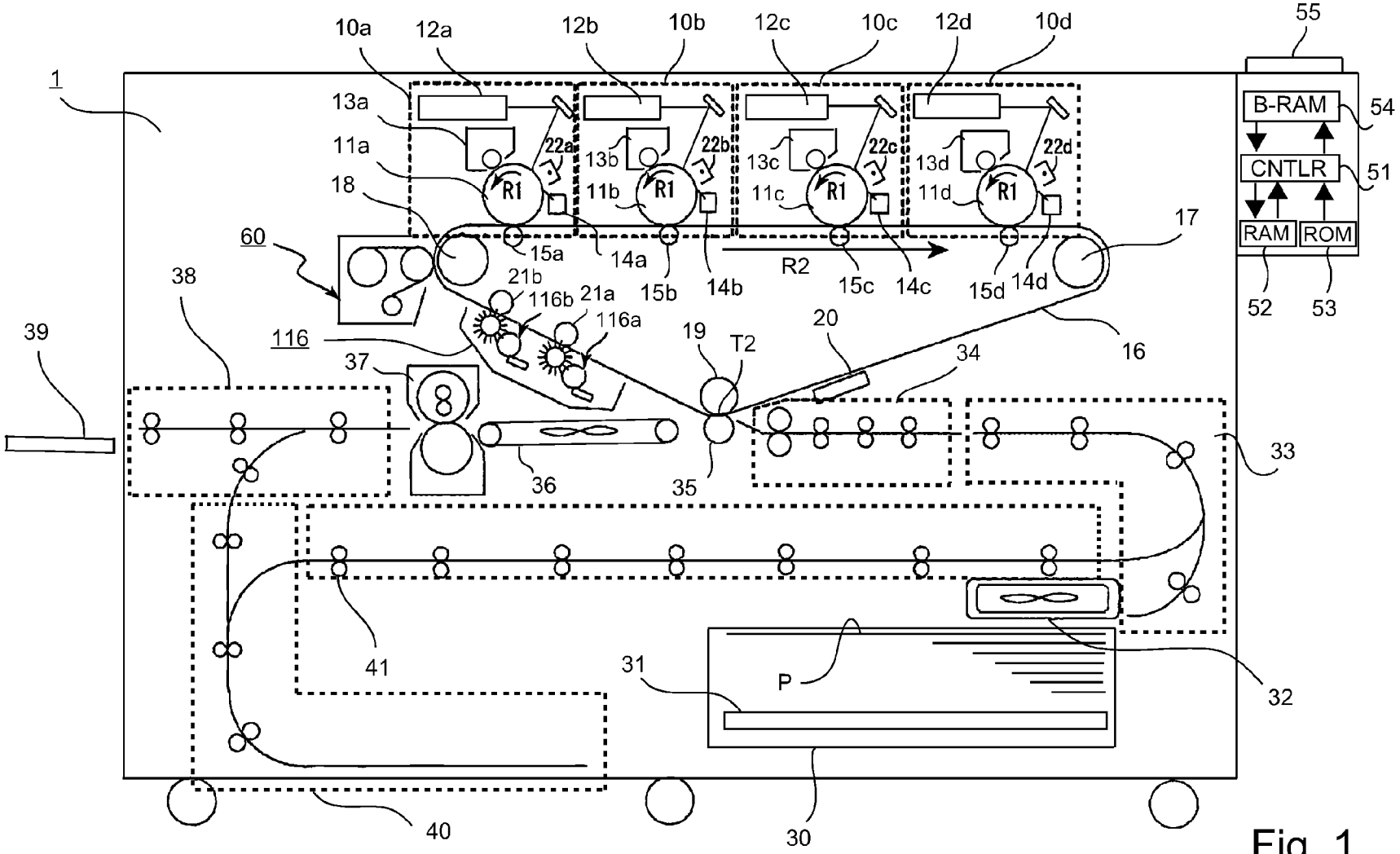
FIG. 1 is an illustration of a general structure of an image forming apparatus.

FIG. 1 is an illustration of a general structure of an image forming apparatus.

As shown in FIG. 1, an image forming apparatus 1 in this embodiment is a tandem and intermediary transfer type full-color printer in which image forming portions 10*a*, 10*b*, 10*c* and 10*d* for yellow, magenta, cyan and black are arranged along an intermediary transfer belt 16.

At the image forming portion 10*a*, a yellow toner image is formed on a photosensitive drum 11*a* and then is primary-transferred onto the intermediary transfer belt 16. At the image forming portion 10*b*, a magenta toner image is formed on a photosensitive drum 11*b* and is primary-transferred onto the intermediary transfer belt 16. At the image forming portions 10*c* and 10*d*, a cyan toner image and a black toner image are formed on photosensitive drums 11*c* and 11*d*, respectively, and are successively primary-transferred onto the intermediary transfer belt 16.

The four color toner images transferred on the intermediary transfer belt 16 are conveyed to a secondary transfer portion T2 and then are collectively secondary-transferred onto a recording material P.

The recording material P accommodated in a feeding unit 30 is separated one by one by a feeding separation portion 32, and then is sent to a registration unit 34 by a feeding and conveying unit 33. The registration unit 34 synchronizes the recording material P with the toner images on the intermediary transfer belt 8 to send the recording material P to the secondary transfer portion T2.

The recording material P on which the toner images are transferred is conveyed to a fixing unit 37 by a front conveying unit 36 for fixing and then is heated and pressed by the fixing unit 37, so that the toner images are fixed.

In the case of one-side printing, the recording material P is conveyed by a discharging unit 38 and then is discharged onto a discharge tray 39. On the other hand, in the case of double-side printing, the recording material P is conveyed to a reversing unit 40, so that the recording material P is turned upside down and thereafter is passed through a conveying unit 41 for double-side printing and the feeding and conveying unit 33 to be conveyed to the registration unit 34. Then, the image is transferred and fixed on the back surface of the recording material P, and thereafter the recording material P is discharged onto the discharge tray 39.

The image forming portions 10*a*, 10*b*, 10*c* and 10*d* have the substantially same constitution except that the colors of toners used in developing devices 13*a*, 13*b*, 13*c* and 13*d* are different from each other.

In the following description, the image forming portion 10*a* will be described and with respect to other image forming portions 10*a*, 10*b* and 10*d*, the suffix a of reference numerals (symbols) for representing of the image forming portion 10*a* is to be read as b, c and d, respectively, for explanation of associated ones of the constituent members.

The image forming portion 10*a* includes the photosensitive drum 11*a*. Around the photosensitive drum 11*a*, a corona charger 22*a*, an exposure device 12*a*, the developing device 13*a*, a primary transfer roller 15*a*, and a drum cleaning device 14*a* are disposed. The photosensitive drum 11*a* is constituted by an aluminum cylinder on its outer peripheral surface of which a photosensitive layer is formed and is rotated in an arrow R1 direction.

The corona charger 22*a* electrically charges the surface of the photosensitive drum 11*a* to a uniform negative dark portion potential VD. The exposure device 12*a* scans the charged surface of the photosensitive drum 11*a* with a laser beam through a rotating mirror, so that an electrostatic image for an image is formed (written) on the surface of the photosensitive drum 11*a*. The developing device 13*a* develops the electrostatic image with a developer containing the toner and a carrier to form the toner image on the surface of the photosensitive drum 11*a*.

The primary transfer roller 15*a* urges an inner surface of the intermediary transfer belt 16 to form a primary transfer portion between the photosensitive drum 11*a* and the intermediary transfer belt 16. To the primary transfer roller 15*a*, a DC voltage of a positive (+) polarity is applied, so that the toner image of a negative (−) polarity carried on the photosensitive drum 11*a* is primary-transferred onto the intermediary transfer belt 16. The drum cleaning device 14*a* collects the transfer residual toner remaining on the photosensitive drum 11*a*.

A controller 51 controls respective portions of a main assembly of the image forming apparatus 1 to execute image formation. To the controller 51, RAM 42 used as an operating memory, ROM 52 in which programs to be executed and various data are stored, and back-up RAM 54 for backing up obtained data and the like are connected.

<Intermediary Transfer Belt>

The intermediary transfer belt 16 is stretched by a tension roller 17, a driving roller 18 and a secondary transfer inner roller 19, and predetermined tension is applied to the intermediary transfer belt 16 by the tension roller 17. The driving roller 18 rotates the intermediary transfer belt 16 in an arrow R2 direction. A rotational speed of the intermediary transfer belt 16 is 300 mm/sec.

The intermediary transfer belt 16 is a so-called elastic belt prepared by coating the surface of a resin-made belt base material with an elastic rubber layer. As the base material, a resin material such as polyimide, PET, PVDF or the like is used, and as the material for the elastic layer, silicone rubber, urethane rubber or the like is used. The elastic layer forms a stable transfer nip at the secondary transfer portion T2, thus enabling transfer of a high-quality toner image on various recording materials P.

On the intermediary transfer belt 16, after the toner image is carried and then is transferred onto the recording material P, a part of the toner image remains as the transfer residual toner without being transferred onto the recording material P, and therefore there is a need to perform cleaning of the surface of the intermediary transfer belt 16 before the intermediary transfer belt 16 is subjected to subsequent image formation. However, when a cleaning blade is contacted to the elastic belt, a blade edge bites into the surface layer to increase a contact resistance, and therefore a belt cleaning device using the cleaning blade is not readily employed. For that reason, in the image forming apparatus 1, a belt cleaning device 116 of an electrostatic fur brush cleaning type in which the transfer residual toner is collected electrically by using a fur brush which is a brush member to be rotationally driven is employed. Further, downstream of the belt cleaning device 116, a web cleaning device 60 for wiping the toner with a non-woven cloth is provided.

<Belt Cleaning Device>

Figure 2:
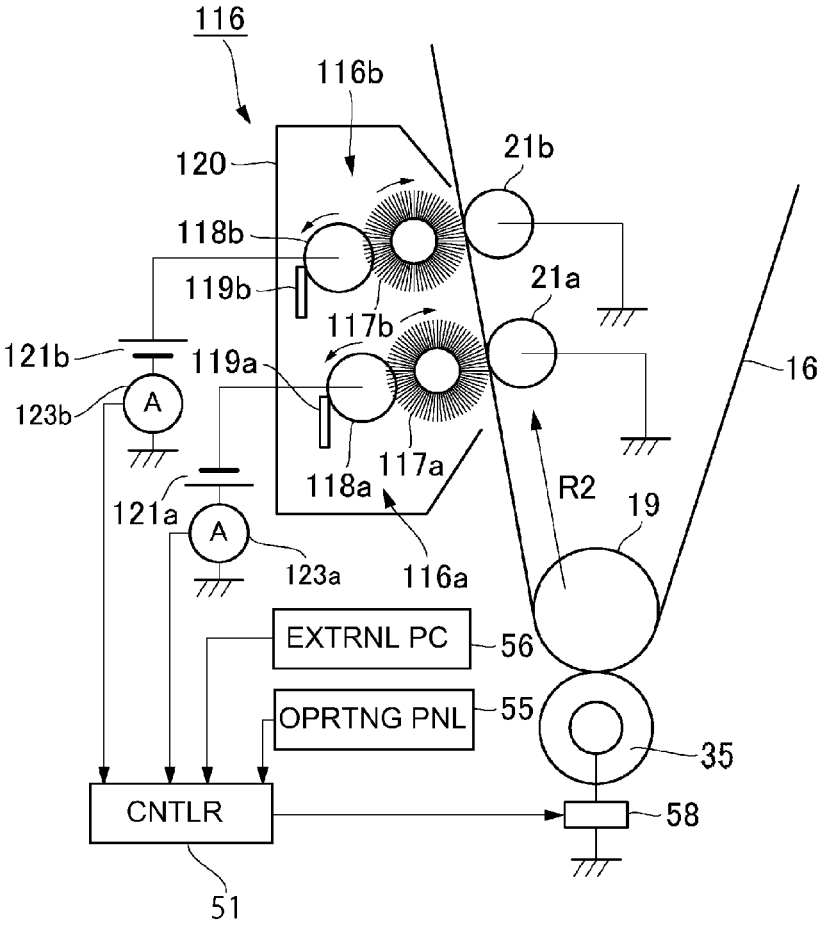
FIG. 2 is an illustration of a structure of a belt cleaning device.

FIG. 2 is an illustration of a structure of the belt cleaning device 116. As shown in FIG. 2, a first electrostatic cleaning portion 116*a* includes a fur brush 117*a*, a first metal roller 118*a* which is to be rotationally driven and which is contacted to the fur brush 117*a*, and a first cleaning blade 119*a* contacted to the first metal roller 118*a*. The first electrostatic cleaning portion 116*a* brings the fur brush 117*a*, which is an example of a first electroconductive member to which a voltage of an identical polarity to the toner charge polarity is applied, into contact with the surface of the intermediary transfer belt 16 to collect the transfer residual toner passed through the secondary transfer portion T2. A second electrostatic cleaning portion 116*b* includes a fur brush 117*b*, which is a brush member to be rotationally driven, a second metal roller 118*b* which is to be rotationally driven and which is contacted to the fur brush 117*b*, and a second cleaning blade 119*b* contacted to the second metal roller 118*b*. The second electrostatic cleaning portion 116*b* brings the fur brush 117*b*, which is an example of a second electroconductive member to which a voltage of an opposite polarity to the toner charge polarity is applied, into contact with the surface of the intermediary transfer belt 16 to collect the transfer residual toner passed through the secondary transfer portion T2.

The first electrostatic cleaning portion 116*a* includes the fur brush 117*a*, an opposite roller 21*a*, the metal roller (bias roller) 118*a* and the cleaning blade 119*a*, and applies to the fur brush 117*a* the voltage of the identical polarity to the toner charge polarity. The second electrostatic cleaning portion 116*b* includes the fur brush 116*b*, an opposite roller 21*b*, the metal roller 118*b* and the cleaning blade 119*b*, and applies to the fur brush 117*b* the voltage of the opposite polarity to the toner charge polarity.

Each of the fur brushes 117*a* and 117*b* has a length of 340 mm and is disposed with a maintained penetration (entering) amount of about 1.0 mm with respect to the intermediary transfer belt 16, and is rotationally driven at a peripheral speed of 50 mm/sec in a counter direction to a movement direction of the intermediary transfer belt 16. Each of the fur brushes 117*a* and 117*b* has a total resistance value of 10 DC when being rotated in direct contact with the metal roller 118*a* or 118*b*, and is prepared by planting on a core metal, each black-dispersed nylon fibers of 6 denier in fiber thickness at a fiber-planting density of 500,000 fibers/inch$^2$. The fur brush 117*a* is 15 mm in diameter, 6 mm in core metal diameter and 4.5 mm in fiber length. The fur brush 117*b* is 18 mm in diameter, 8 mm in core metal diameter and 5 mm in fiber length.

At opposing positions to the fur brushes 117*a* and 117*b*, the opposite rollers 21*a* and 21*b* are disposed, respectively, via the intermediary transfer belt 16. The opposite rollers 21*a* and 21*b* are contacted to the inner surface of the intermediary transfer belt 16 and are electrically grounded to the ground potential.

Each of the metal rollers 118*a* and 118*b* is formed of aluminum, and the surface thereof is subjected to hard alumite (anodized aluminum) treatment. The metal rollers 118*a* and 118*b* are disposed with the penetration amount of about 10 mm with respect to the fur brushes 117*a* and 117*b*, respectively, and are rotationally driven at the same speeds as those of the fur brushes 117*a* and 117*b*, respectively, in the same directions as those of the fur brushes 117*a* and 117*b*, respectively, at their opposing position. The cleaning blades 119*a* and 119*b* are formed with the urethane rubber and are disposed with a maintained penetration amount of about 1.0 mm with respect to the metal rollers 118*a* and 118*b*, respectively.

A power source 121*a* applies a DC voltage of the negative polarity to the metal roller 118*a*. A value of the applied DC voltage is set before start of an image forming job so that an amount of a current passing through a current detecting circuit 123*a* is −35 μA. When the cleaning current amount is excessively small, toner collecting power is lowered, and when the cleaning current amount is excessively large, an amount of electric discharge between the intermediary transfer belt 16 and the fur brush 117*a* is increased and thus the toner collecting power is lowered. At the first electrostatic cleaning portion 116*a*, from a balance of these factors, −35 μA is set as an optimum value.

The transfer residual toner electrically charged to the positive polarity on the intermediary transfer belt 16 is electrostatically moved onto the metal roller 118*a* via the fur brush 117*a*, and thereafter is scraped into a device housing 120 by the cleaning blade 119*a*.

A power source 121*b* applies a DC voltage of the positive polarity to the metal roller 118*b*. A value of the applied DC voltage is set before start of an image forming job so that an amount of a current passing through a current detecting circuit 123*b* is +35 μA. When the current amount is excessively small, toner collecting power is lowered, and when the current amount is excessively large, an amount of electric discharge between the intermediary transfer belt 16 and the fur brush 117*b* is increased and thus the toner collecting power is lowered. At the second electrostatic cleaning portion 116*b*, from a balance of these factors, +25 μA is set as an optimum value.

Even when the transfer residual toner on the intermediary transfer belt 16 is removed by the fur brush 117*a*, on the intermediary transfer belt 16, an uncharged toner and the transfer residual toner electrically charged to the normal polarity (−) still remain. The uncharged toner is electrically charged gradually to the negative (normal) polarity (−) by being subjected to charge injection by the DC voltage of the normal polarity (−) applied to the fur brush 117*a*. The transfer residual toner electrically charged to the normal polarity (−) is deposited on the fur brush 117*b* to which the DC voltage of the positive polarity (+) is applied, thus being removed from the intermediary transfer belt 16. The transfer residual toner electrically charged to the negative polarity on the intermediary transfer belt 16 is electrostatically moved onto the metal roller 118*b* via the fur brush 117*b*, and thereafter is scraped into a device housing 120 by the cleaning blade 119*b*.

The belt cleaning device 116 is capable of removing the transfer residual toner, remaining on the intermediary transfer belt 16 and not being completely transferred at the secondary transfer portion T2, irrespective of the charge polarity of the transfer residual toner by using the fur brushes 117*a* and 117*b*. However, a maximum design throughput of the belt cleaning device 116 is 0.2 mg/cm$^2$. Therefore, when a toner density on the intermediary transfer belt 16 exceeds 0.2 mg/cm$^2$, the toner image cannot be removed by a single operation.

There is a limit to the cleaning power of the fur brushes 117*a* and 117*b*. When the toner in an amount more than that of the toner moved to the metal rollers 118*a* and 118*b* is continuously moved from the intermediary transfer belt 16 to the fur brushes 117*a* and 117*b*, the cleaning performance of the fur brushes 117*a* and 117*b* is gradually lowered by accumulation of the toner on the fur brushes 117*a* and 117*b*. When a total amount of the toner accumulated on the fur brushes 117*a* and 117*b* exceeds 2.2 g, the amount of the toner moved to the intermediary transfer belt 16 becomes larger than the amount of the toner collected from the intermediary transfer belt 16 by the fur brushes 117*a* and 117*b*. For that reason, in the case where the toner remains in a large amount on the intermediary transfer belt 16 due to jam of the recording material or the like, the belt cleaning device 116 virtually loses its cleaning performance.

For that reason, in such a case, idling of the intermediary transfer belt 16 and the belt cleaning device 116 is performed, so that there is a need to move and collect the toner accumulated on the fur brushes 117*a* and 117*b* onto the metal rollers 118*a* and 118*b*. Thus, the belt cleaning device 116 is operated in a state in which the total amount of the toner accumulated on the fur brushes is maintained so as not to exceed 1.5 g.

It is also possible to enhance the toner collecting power by upsizing of the fur brushes 117*a* and 117*b* and an increase in rotational speed of the metal rollers 118*a* and 118*b*. However, there are problems of durable lifetime, frictional heat, upsizing and the like of the cleaning blades 119*a* and 119*b*, and therefore the above-described settings are employed.

<Relationship Between Transfer Residual Toner Amount and Cleaning Current>

Figure 3:
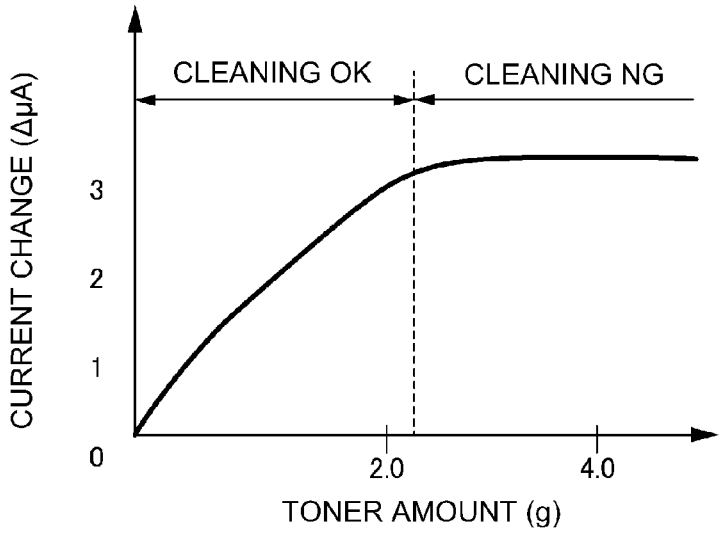
FIG. 3 is a graph showing a relationship between a toner accumulation amount of a downstream fur brush and a current passing through a metal roller.

FIG. 3 is a graph showing a relationship between the toner accumulation amount of the downstream fur brush 117*b* and a current passing through the downstream metal roller 118*b*. As shown in FIG. 3 with reference to FIG. 2, with an increase in toner accumulation amount by use of the fur brush 117*b* from an initial state, a decrease amount of the current passing through the fur brush 117*b* is increased. When the transfer residual toner is transferred from the intermediary transfer belt 16 onto the fur brush 117*b* to increase the total amount of the accumulated toner, a contact resistance of the fur brush 117*b* to the intermediary transfer belt 16 is increased and thus the current flowing from the power source 121*b* into the metal roller 118*b* is decreased. The high-resistance toner deposited on the fur brush 17*b* prevents electric conduction between the intermediary transfer belt 16 and the fur brush 117*b*. When the toner and silica or the like externally added to the toner are deposited on the fur brush 117*b*, a contact area between the intermediary transfer belt 16 and the nylon fibers of the fur brush 117*b* is decreased, so that it is difficult to transfer the electric charges.

Then, when the toner accumulation amount of the fur brush 117*b* exceeds 2.2 g, the current decrease amount is not increased. At this time, the toner accumulation amount of the fur brush 117*b* has already been saturated, and as described above, the cleaning performance of the fur brush 117*b* is impaired, so that improper cleaning is generated. The relationship of FIG. 3 is similarly established also with respect to the upstream fur brush 117*a* in a state in which the current polarity is reversed.

In view of the above factors, in the image forming apparatus 1, control is effected so that the toner accumulation amount of each of the fur brushes 117*a* and 117*b* is 1.5 g or less.

That is, from the graph of FIG. 3, the control is effected so that the decrease amount of the cleaning current from the initial state is 2 μA or less.

<ATVC Control>

As shown in FIG. 2, at the secondary transfer portion T2 which is an example of a transfer portion, the voltage is applied, so that the toner image carried on the intermediary transfer belt 16 which is an example of the image bearing member is transferred onto the recording material which is an example of a transfer material. At the secondary transfer portion T2, the recording material is nipped and conveyed between a secondary transfer roller 35 and the intermediary transfer belt 16 which is an example of an intermediary transfer member. The secondary transfer roller 35 is contacted to the intermediary transfer belt 16 supported by an opposite roller 19 to form the secondary transfer portion T2. A power source 58 applies a constant voltage to the secondary transfer portion T2 where the recording material is nipped and conveyed, so that the toner image is transferred from the intermediary transfer belt 16 onto the recording material P.

The controller 51 applies, during turning-on of a main assembly switch and before the start of the image forming job, voltages at a plurality of levels to the secondary transfer roller 35 to obtain a V-I characteristic at the secondary transfer portion T2. Further, from the obtained V-I characteristic, a voltage corresponding to a transfer current of 50 μA is determined as a constant voltage to be applied during the image formation, and then constant voltage control is effected at the voltage during the image formation.

The controller 51 includes a table of a target current value (It) depending on ambient temperature and humidity in the main assembly in order to make setting of the transfer voltage depending on the toner charge characteristic. In ATVC control during rise of the main assembly, in a non-sheet-passing state of the recording material, voltages of two values set in advance depending on the ambient temperature and humidity are applied, and then the V-I characteristic is obtained from current values obtained at the time of the voltage application, and thereafter a voltage value from which the target current can be obtained is computed (calculated).

<Relationship Between Transfer Residual Toner Amount and Transfer Current>

Figure 4:
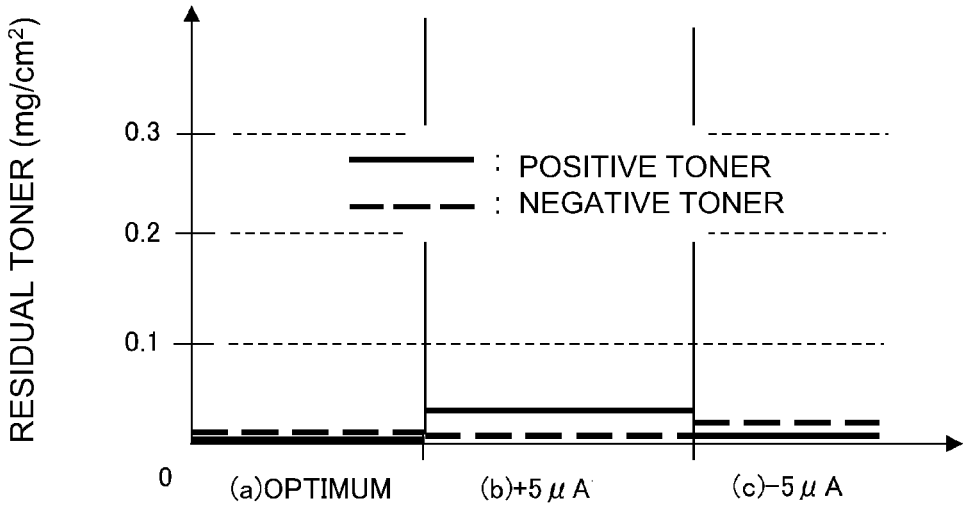
FIG. 4 is a graph for illustrating a transfer residual toner charge polarity with respect to an image with a small toner use amount.
Figure 5:
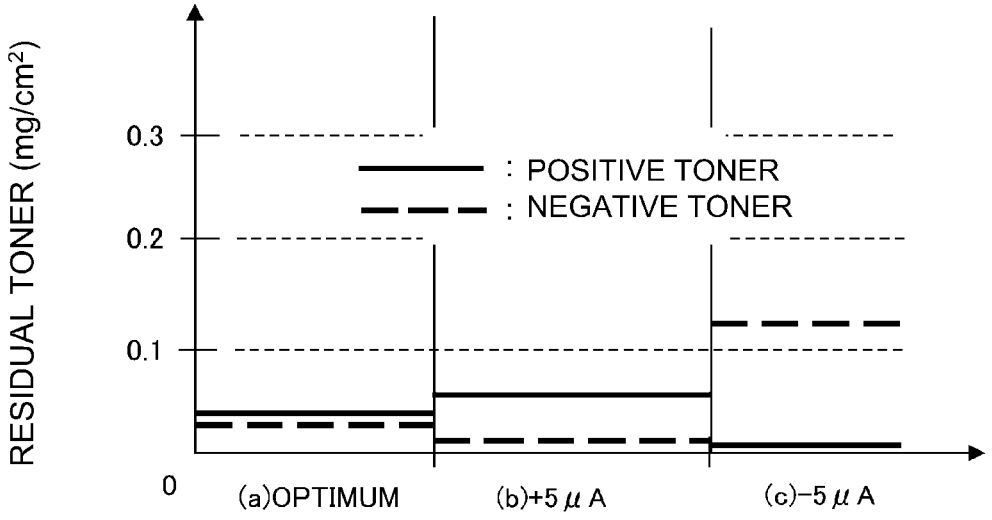
FIG. 5 is a graph for illustrating the transfer residual toner charge polarity with respect to an image with a large toner use amount.

FIG. 4 is a graph for illustrating the charge polarity of the transfer residual toner with respect to an image with a small toner use amount. FIG. 5 is a graph for illustrating the charge polarity of the transfer residual toner with respect to an image with a large toner use amount.

The image forming apparatus of an electrophotographic type is, in recent years, improved remarkably in image quality and moves into light printing market, so that its scale is enlarged year by year. A printing apparatus of the electrophotographic type is small in size compared with a conventional printing apparatus using ink and therefore is placed in an office environment even when the printing apparatus is a machine for use in the light printing. In the office environment, compared with an environment in which the conventional printing apparatus using ink is placed, an air conditioner is not equipped in many cases, so that a degree of environmental change in use is large. Also a state of the recording material is changed with the environmental change in use. The electrophotographic system uses static electricity and therefore an image density of an output image is largely changed depending on the change in temperature, humidity, the recording material or the like. In the electrophotographic system, when setting of a proper transfer voltage cannot be made, the amount of the transfer residual toner remaining on the intermediary transfer belt 16 without being secondary-transferred becomes large, so that when the toner in amount exceeding the toner collecting power of the belt cleaning device 116 is conveyed, the improper cleaning is generated.

As shown in FIG. 2, in the case of the image forming apparatus 1, the ATVC control is effected during non-image formation and then the transfer voltage is set, but the set transfer voltage is not always optimum at the time of the toner image transfer during the image formation. In the type of the machine, for the light printing, with high accuracy and high speed, continuous output for several hours is performed, and therefore even when there is only a slight deviation in transfer voltage, the transfer residual toner is accumulated on the fur brushes 117*a* and 117*b*, so that a large load is exerted on the belt cleaning device 116 in some cases.

In the case where the transfer voltage applied to the secondary transfer portion T2 is excessively small, the toner image carried on the intermediary transfer belt 16 cannot be sufficiently transferred onto the recording material, and therefore the transfer efficiency of the toner image is lowered. However, when the transfer voltage applied to the secondary transfer portion T2 is excessively large, a phenomenon that the toner is electrically charged to the opposite polarity by, e.g., injection of electric charges of the positive polarity (+) into the toner transferred on the recording material and then is transferred back from the recording material to the intermediary transfer belt 16 to constitute the transfer residual toner is dominant.

Further, in the electrophotographic system in which the transfer is performed by giving and receiving of the electric charges, it is difficult to make setting of the transfer current such that the transfer residual toner amount is minimum with respect to an image with any toner amount per unit area. In the secondary transfer step in which the toner image is transferred onto the recording material, the optimum transfer voltage varies also depending on loss of the recording material and a storage state of the recording material and therefore it is difficult to continuously ensure an optimum secondary transfer property stably while applying the same transfer voltage from start to end of the image formation.

The image formation was effected at each of the optimum transfer voltage, an excessively large transfer voltage providing a transfer current which is 5 μA larger than that in the case of the optimum transfer voltage, and an excessively small transfer voltage providing a transfer current which is 5 μA smaller than that in the case of the optimum transfer voltage, and then the charge polarity of the transfer residual toner was checked. In an environment of a temperature of 23° C. and a humidity of 50% RH, the image formation of each of a 50%-duty image (FIG. 4) and a 200%-duty image (FIG. 5) was effected. In each of the cases, the transfer residual toner on the intermediary transfer belt 16 was collected at a predetermined point downstream of the secondary transfer portion T2, and then each of the toner amounts (per unit area) of the positively charged (+) toner and the negatively charged (−) toner was measured.

The term "duty" refers to a ratio when the toner amount for obtaining a maximum reflection density D=1.2 of a single color image on the recording material (paper) is taken as 100%. For measurement of the maximum density on the paper, a reflection densitometer ("MODEL 504", mfd. X-rite Co.) is used. As the 50%-duty image, a black image but a single-color halftone image with a medium gradation level is assumed. As the 200%-duty image, a superposed image of a 100% magenta image and a 100% cyan image, i.e., an image with the maximum toner amount of the four-color based full-color image is assumed.

For measurement of a distribution of the electric charge amount of the collected toner, an analyzer ("Espart Analyzer", mfd. by Hosokawa Micron Corp.) was used. The analyzer measures a movement speed of toner particles by a laser Doppler method after introducing the charged toner into a detecting portion (measuring portion) where electric field and sound (acoustical) field are concurrently formed. Then, the analyzer measures a particle size and a charge amount of every toner particle, and counts and adds up the number of detection of every section of a combination of the particle size and the charge amount.

The optimum secondary transfer current was obtained by effecting image formation on the actual recording material while changing the secondary transfer current by 5 μA increments to measure the reflection density of the fixed image and then by selecting the secondary transfer current providing the maximum density. As a result, in the image formation of the 50%-duty image, the optimum value of the secondary transfer current was 40 μA, and in the image formation of the 200%-duty image, the optimum value of the secondary transfer current was 45 μA.

As shown at (a) of FIG. 4, with respect to an image with a small toner amount, the amount of the transfer residual toner becomes smallest when setting of the secondary transfer current is the optimum value of 40 μA. Further, as shown at (b) of FIG. 4, in the case where the setting of the secondary transfer current is 45 μA which is 5 μA larger than the optimum value, the amount of the negatively charged transfer residual toner is not changed but only the amount of the positively charged transfer residual toner is increased. On the other hand, as shown at (c) of FIG. 4, in the case where the setting of the secondary transfer current is 35 μA which is 5 μA smaller than the optimum value, the amount of the positively charged transfer residual toner is not changed but only the amount of the negatively charged transfer residual toner is increased.

As shown in (a) of FIG. 5, with respect to an image with a large toner amount, although the amount of the transfer residual toner becomes larger than that of the image with the small toner amount, a larger one of the amounts of the transfer residual toner becomes smallest when setting of the secondary transfer current is the optimum value of 45 μA. Further, as shown in (b) of FIG. 5, in the case where the setting of the secondary transfer current is 50 μA which is 5 μA larger than the optimum value, the amount of the negatively charged transfer residual toner is somewhat decreased but the amount of the positively charged transfer residual toner is somewhat increased. On the other hand, as shown at (c) of FIG. 5, in the case where the setting of the secondary transfer current is 40 μA which is 5 μA smaller than the optimum value, the amount of the positively charged transfer residual toner is decreased but the amount of the negatively charged transfer residual toner is considerably increased.

When FIGS. 4 and 5 are compared, in both of the case where the toner amount (per unit area) is large and the case where the toner amount (per unit area) is small, when the secondary transfer current setting is larger than the optimum value, the amount of the positively charged toner is increased but the amount of the negatively charged toner is decreased. On the other hand, when the secondary transfer current setting is smaller than the optimum value, the amount of the negatively charged toner is increased but the amount of the positively charged toner is decreased. Further, the image obtained by superposing the 100% magenta image with the 100% cyan image (the 200%-duty image) has a larger toner amount on the intermediary transfer belt 16 than the 50%-duty image, and therefore sensitivity of the transfer residual toner amount with respect to a deviation of the secondary transfer current setting in the case of the 200%-duty image is high.

When FIGS. 4 and 5 are compared, the transfer residual toner amount varies depending on the toner amount per unit area of the image, and therefore only from an absolute amount of the transfer residual toner, whether the secondary transfer current setting is optimum, excessively large or excessively small cannot be discriminated. However, when a larger one of the positively charged transfer residual toner amount and the negatively charged transfer residual toner amount is discriminated, it is possible to at least discriminate as to whether the secondary transfer current is excessively large or excessively small.

Therefore, in the following Embodiments, a cleaning current is detected every predetermined period to check whether or not the transfer voltage is proper. A toner accumulation amount in a predetermined period is compared between the fur brush 117*a* on which the positively charged toner is to be deposited and the fur brush 117*b* on which the negatively charged toner is to be deposited, so that whether the transfer voltage is excessive or insufficient is discriminated. Then, in the case where the transfer voltage is excessive, the secondary transfer current setting is lowered by 1 μA each, and in the case where the transfer voltage is insufficient, the secondary transfer setting is raised by 1 μA each. As a result, even when the recording material, the toner state or the disposition environment is changed, the cleaning system can be stably operated for a long term.

Embodiment 1

Figure 6:
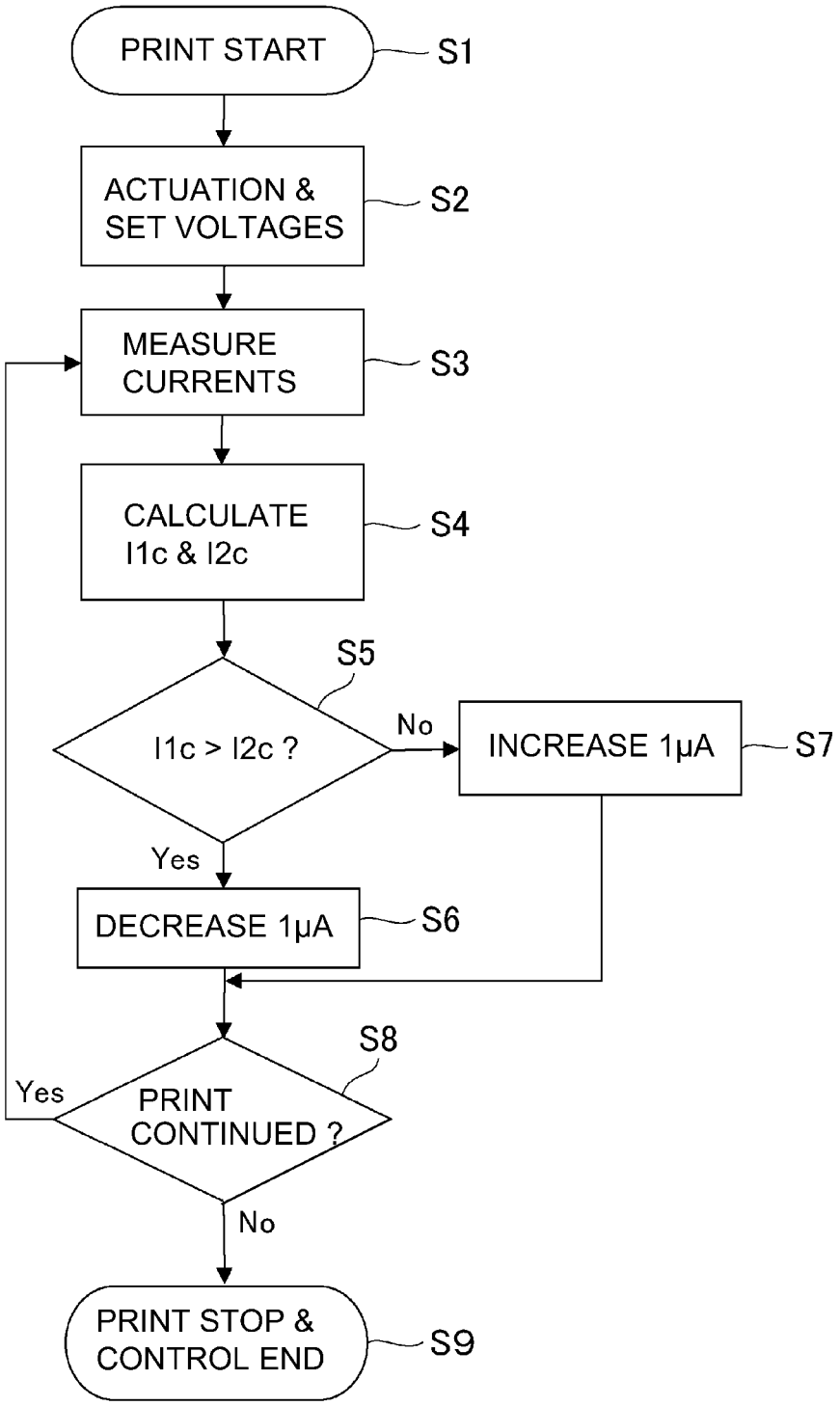
FIG. 6 is a flow chart of transfer voltage control in Embodiment 1.

FIG. 6 is a flow chart of transfer voltage control in this embodiment. In this embodiment, the transfer voltage is optimized by using relationships, shown in FIGS. 4 and 5, between the change in cleaning current and the accumulation amounts of the fur brushes 117*a* and 117*b* on which the transfer residual toner is collected.

As shown in FIG. 2, a current measuring circuit 123*a* which is an example of a first detecting means outputs first information corresponding to a current passing through the fur brush 117*a*. The current measuring circuit 123*a* outputs first information on the basis of a contact resistance of the fur brush 117*a*. The current measuring circuit 123*a* outputs first information on the basis of the amount of the transfer residual toner, to be caught by the fur brush 117*a*, electrically charged to the opposite polarity to the toner charge polarity.

A current measuring circuit 123*b* which is an example of a second detecting means outputs second information corresponding to a current passing through the fur brush 117*b*. The current measuring circuit 123*b* outputs second information on the basis of a contact resistance of the fur brush 117*b*. The current measuring circuit 123*b* outputs second information on the basis of the amount of the transfer residual toner, to be caught by the fur brush 117*b*, electrically charged to the identical polarity to the toner charge polarity. Each of the current measuring circuits 123*a* and 123*b* is capable of detecting, with accuracy of 0.2 μA, the current passing between itself and the intermediary transfer belt 16 via the fur brush 117*a* or 117*b*.

The controller 51 which is an example of a control means controls the voltage to be applied to the secondary transfer portion T2 on the basis of the first information and the second information. The controller 51 obtains the first information and the second information at a timing of every image formation of a predetermined number of sheets, and then controls the voltage to be applied to the secondary transfer portion T2. The controller 51 controls the voltage to be applied to the secondary transfer portion T2 on the basis of a difference amount of the first information between the last (preceding) measurement and this (current) measurement and a difference amount of the second information between the preceding measurement and the current measurement.

The controller 51 lowers, when a decrease amount of the current passing through the fur brush 117*a* becomes larger than a decrease amount of the current passing through the fur brush 117*b*, the voltage to be applied to the transfer portion during the image formation by only one unit. The controller 51 lowers, when an increase amount of the contact resistance of the fur brush 117*a* becomes larger than an increase amount of the contact resistance of the fur brush 117*b*, the voltage to be applied to the transfer portion during the image formation by only one unit. The controller 51 lowers, when the amount of the transfer residual toner caught by the fur brush 117*a* becomes larger than the amount of the transfer residual toner caught by the fur brush 117*b*, the voltage to be applied to the transfer portion during the image formation by only one unit.

The controller 51 raises, when a decrease amount of the current passing through the fur brush 117*b* becomes larger than a decrease amount of the current passing through the fur brush 117*a*, the voltage to be applied to the transfer portion during the image formation by only one unit. The controller 51 raises, when an increase amount of the contact resistance of the fur brush 117*b* becomes larger than an increase amount of the contact resistance of the fur brush 117*a*, the voltage to be applied to the transfer portion during the image formation by only one unit. The controller 51 raises, when the amount of the transfer residual toner caught by the fur brush 117*b* becomes larger than the amount of the transfer residual toner caught by the fur brush 117*a*, the voltage to be applied to the transfer portion during the image formation by only one unit.

As shown in FIG. 6 with reference to FIG. 2, the controller 51 starts a printer operation by receiving a print start command (instruction) from an external input terminal 56 or by touching a print button displayed on an operating portion 55 (S1).

The controller 51 actuates the image forming apparatus 1 before the start of the printer operation and then make settings of various high voltages and the like (S2).

The controller 51 sets, on the basis of a result of the ATVC control effected at the time of the start-up of the main assembly, a voltage value from which a target current value (It) is obtained at the secondary transfer portion T2. Here, the target current value (It) is 45 μA in an environment of 23° C. and 50% RH. The controller 51 applies, in the control during the printing by constant voltage control, a voltage of which value is obtained by adding the recording material sharing voltage, set in advance depending on the recording material to be passed, to a voltage value on the basis of the result of the ATVC control.

The controller applies, at the first electrostatic cleaning portion 116*a* at the time of the start-up of the main assembly, constant voltages of two levels to the metal roller 118*a* to measure a V-I characteristic in a contact state between the fur brush 117*a* and the intermediary transfer belt 16. Then, on the basis of the thus obtained V-I characteristic, the controller 51 sets a constant voltage Via to be applied to the metal roller 118*a* so that a cleaning current of −35 μA can be obtained. The controller applies, at the second electrostatic cleaning portion 116*b* at the time of the start-up of the main assembly, constant voltages of two levels to the metal roller 118*b* to measure a V-I characteristic in a contact state between the fur brush 117*b* and the intermediary transfer belt 16. Then, on the basis of the thus obtained V-I characteristic, the controller 51 sets a constant voltage V1*b* to be applied to the metal roller 118*b* so that a cleaning current of +35 μA can be obtained. In the image forming apparatus 1, the cleaning current is set at −35 μA in the upstream side and +35 μA in the downstream side but is not limited to these values. It is possible to employ different values depending on the toner charge characteristic and the like.

The controller 51 measures values of cleaning currents (I1*b* and I2*b*) passing through the first electrostatic cleaning portion 116*a* and the second electrostatic cleaning portion 116*b*, respectively, by using the current measuring circuits every image formation of 10 sheets of an A4-sized recording material fed by a long edge feeding manner (S3). Here, the reason why the timing of every image formation of 10 sheets is selected is that from a result of previous studies, even in the case where the transfer voltage setting is deviated from the optimum value in a maximum degree, the far brushes absorb (collect) the transfer residual toners until 30 sheets and thus the improper cleaning is not generated. However, the timing is not limited to every image formation of 10 sheets but may also be changed depending on the type of the recording material used, the ambient temperature and humidity, and the like.

The controller 51 computes (calculates) differences (I1*c*, I2*c*) between cleaning currents (I1*b*, I2*b*) measured at the timing of every image formation of 10 sheets and cleaning currents (I1*a*, I2*a*) measured at the time of the start of the printing, on the basis of equations (1) and (2) below (S4). Specifically, the difference value I1*c* of the cleaning current at the first electrostatic cleaning portion 116*a* where the positively charged transfer residual toner is to be collected, and the difference value I2*c* of the cleaning current at the second electrostatic cleaning portion 116*b* where the negatively charged transfer residual toner is to be collected are computed.

$$I1c=I1a-I1b \quad (1)$$

$$I2c=I2a-I2b \quad (2)$$

The controller 51 discriminates which value of the cleaning current difference value I1*c* at the first electrostatic cleaning portion 116*a* and the cleaning current difference value I2*c* at the second electrostatic cleaning portion 116*b* is smaller. The controller 51 compares which value of the accumulation amount of the positively charged toner and the accumulation amount of the negatively charged toner is larger. The controller discriminates which value of the contact resistance increase amount of the fur brush 117*a* by the positively charged toner and the contact resistance increase amount of the fur brush 117*b* by the negatively charged toner is larger.

As a result of the comparison, in the case where the cleaning current decrease amount I1*c* at the first electrostatic cleaning portion 116*a* is larger than the cleaning current decrease amount I2*c* at the second electrostatic cleaning portion 116*b*, the controller 51 changes the transfer voltage so that the transfer current is decreased by 1 μA (S6). The change amount of the transfer voltage is computed on the basis of the V-I characteristic which is obtained at the time of the start-up of the main assembly and then is stored in the back-up RAM 54 (FIG. 1). The large current change amount at the first electrostatic cleaning portion 116*a* means that the positively charged toner located on the surface of the intermediary transfer belt 16 passed through the secondary transfer portion T2 is large in amount. This is because the secondary transfer current value is excessively large in a combination of the recording material and the image which are outputted by the current printing. Accordingly, the set value of the secondary transfer current value is lowered.

As a result of the comparison, in the case where the cleaning current decrease amount I2*c* at the second electrostatic cleaning portion 116*b* is larger than the cleaning current decrease amount I1*c* at the first electrostatic cleaning portion 116*a*, the controller 51 changes the transfer voltage so that the transfer current is increased by 1 μA (S7). The large current change amount at the second electrostatic cleaning portion 116*b* means that the negatively charged toner located on the surface of the intermediary transfer belt 16 passed through the secondary transfer portion T2 is large in amount. This is because the secondary transfer current value is excessively small in a combination of the recording material and the image which are outputted by the current printing. Accordingly, the set value of the secondary transfer current value is raised.

Thereafter, the controller 51 checks whether or not the print output is continued over 10 sheets or more (S8). In the case where the print output of 10 sheets or more is not continued, a changing operation is not performed, so that the printing is stopped and the control is ended (S9). In the case where the print output of 10 sheets or more is continued, after a lapse of the print output of 10 sheets from the preceding adjustment timing, the cleaning currents at the first electrostatic cleaning portion 116*a* and the second electrostatic cleaning portion 116*b* are detected again (S3). The controller 51 controls the transfer voltage to be applied to the secondary transfer portion T2 on the basis of a change in balance of the transfer residual toner accumulation amount between the first electrostatic cleaning portion 116*a* and the second electrostatic cleaning portion 116*b*.

According to Embodiment 1, even when the toner state, the recording material state or the print image toner amount per unit area is changed during the image formation and thus the transfer voltage is out of a transfer voltage range in which the transfer efficiency is high, the transfer voltage is brought near to the transfer voltage range in which the transfer efficiency is high, by 1 μA each and thus can be returned into the transfer voltage range. Therefore, it becomes possible to make optimum setting of the secondary transfer voltage, so that it becomes possible to establish a stable transfer cleaning system for a long term.

According to the control in Embodiment 1, it is possible to change a high-voltage condition at the secondary transfer portion T2 on the basis of the change amount of the cleaning current passing through each of the first electrostatic cleaning portion 116*a* and the second electrostatic cleaning portion 116*b* during the image output. Even when the recording material, the toner state or the disposition environment is changed in any manner, the cleaning system can be stably operated for a long term.

Embodiment 2

In Embodiment 1, in any environment of the ambient temperature and humidity, the correction amount of the secondary transfer high-voltage is 1 μA in terms of the current value, but in this embodiment, the secondary transfer high-voltage correction amount is changed depending on an environmental characteristic of the toner charge amount. The controller 51 decreases a unit adjusting amount of the transfer voltage with a higher humidity in the disposition environment of the image forming apparatus main assembly.

As shown in FIG. 2, the controller 51 sets the secondary transfer high-voltage correction amount at 1.2 μA in terms of the current value in a low humidity environment since the toner charge amount becomes large, and at 0.8 μA in terms of the current value in a high humidity environment since the toner charge amount becomes small. As a result, adjusting sensitivity of the image density can be made uniform in an environment range including the low humidity environment, a medium humidity environment and the high humidity environment.

Embodiment 3

In Embodiment 1, the ATVC control is effected at the time of the start of the image forming job, but in this embodiment, also at a timing of every image formation of 500 sheets of the A4-sized recording material fed in the long edge feeding manner, the image formation is interrupted and then the ATVC control is effected. After the ATVC control, the recording material sharing voltage is corrected depending on a detection result of the cleaning current.

As shown in FIG. 2, the controller 51 which is an example of an executing means executes the ATVC control, which is an example of control in a voltage adjusting mode, during non-image formation every predetermined period. As described above, in the ATVC control, the voltages at the plurality of levels are applied to the secondary transfer portion T2 to obtain the V-I characteristic and then in accordance with the V-I characteristic, the voltage to be applied to the secondary transfer portion T2 is adjusted so that a predetermined transfer current flows.

The controller as the control means controls the predetermined transfer current, used in the ATVC control, on the basis of the first information and the second information. With the increase in contact resistance, when the decrease amount of the current passing through the fur brush 117*a* becomes larger than the decrease amount of the current passing through the fur brush 117*b*, the controller 51 decreases the predetermined. With the increase in contact resistance, when the decrease amount of the current passing through the fur brush 117*b* becomes larger than the decrease amount of the current passing through the fur brush 117*a*, the controller 51 increases the predetermined transfer current.

To the secondary transfer portion T2, during the image formation, a voltage obtained by adding the recording material sharing voltage set of every recording material to a constant voltage set so that the predetermined transfer current flows in a state in which the recording material as the transfer material is not conveyed to the secondary transfer portion T2 is applied. The controller 51 changes the recording material sharing voltage without changing the constant voltage. The controller 51 decreases a decreasing amount of the predetermined transfer current and an increasing amount of the predetermined transfer current, with a higher humidity in the disposition environment of the image forming apparatus main assembly.

According to Embodiment 3, the transfer voltage during the secondary transfer in which the transfer efficiency of the toner image is high during the image formation in which the generation amounts of the positively and negatively charged transfer residual toners are adjusted in their minimum states is reflected in a control result of the ATVC control. Accordingly, the transfer voltage is free from abrupt charge by the ATVC and is free from adjustment at a voltage value where the transfer efficiency is lower than that at the voltage value before the ATVC control.

Embodiment 4

In Embodiment 1, the transfer voltage to be applied to the secondary transfer portion was adjusted depending on the cleaning current balance of the belt cleaning device with respect to the negatively and positively charged transfer residual toners. On the other hand, in this embodiment, a transfer voltage to be applied to the primary transfer portion is adjusted depending on a cleaning current balance of the drum cleaning device with respect to the negatively and positively charged transfer residual toners.

That is, as the drum cleaning device for cleaning the photosensitive drum, the two-stage far brush cleaning device is employed. The controller adjusts, similarly as in Embodiment 1, the voltage to be applied to the transfer portion on the basis of the first information and the second information obtained from the two fur brushes, respectively. The transfer voltage is optimized by obtaining the information, on the transfer residual toner amount, which directly relates to the transfer efficiency. The transfer material may also be the intermediary transfer belt, a recording material carried on a recording material conveying belt or a recording material of sheets which are fed one by one.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 102998/2012 filed Apr. 27, 2012, which is hereby incorporated by reference.

What is claimed is:

1. An image forming apparatus comprising:

an intermediary transfer belt;

a transfer member configured to transfer a toner image from said intermediary transfer belt onto a transfer material at a transfer portion;

a power supply configured to apply a transfer voltage to said transfer member;

a first cleaning member configured to contact with a surface of said intermediary transfer belt at a first cleaning portion to collect toner passed through the transfer portion, a first voltage having an identical polarity to a toner charge polarity being applied to said first cleaning member;

a second cleaning member configured to contact with the surface of said intermediary transfer belt at a second cleaning portion to collect the toner passed through the transfer portion, a second voltage having an opposite polarity to the toner charge polarity being applied to said second cleaning member;

a first detecting member configured to detect a first current passing through said first cleaning member;

a second detecting member configured to detect a second current passing through said second cleaning member;

a memory configured to store information about detection results of said first detecting member and said second detecting member; and a control portion, capable of executing an adjusting mode, configured to detect the first current and the second current using said first and second detecting members, respectively, and configured to adjust the transfer voltage on the basis of detection results of said first and said second detecting members and the information from said memory stored in a previous adjusting mode, the transfer voltage being adjusted to a lower voltage in a case of a first decrease amount being greater than a second decrease amount, and the transfer voltage being adjusted to a higher voltage in a case of the second decrease amount being greater than the first decrease amount, the first decrease amount being a value obtained by subtracting an absolute value of the first current detected in the adjusting mode from an absolute value of the first current detected in the previous adjusting mode, the second decrease amount being a value obtained by subtracting an absolute value of the second current detected in the adjusting mode from an absolute value of the second current detected in the previous adjusting mode.

2. An image forming apparatus according to claim 1, wherein said control portion executes the adjusting mode at a timing of every image formation of a predetermined number of sheets.

3. An image forming apparatus according to claim 1, wherein said first cleaning member is a first brush roller to be rotationally driven, and said first cleaning portion includes a first metal roller to be rotationally driven to contact said first cleaning member and includes a first cleaning blade contacted to the first metal roller, and wherein said second cleaning member is a second brush roller to be rotationally driven, and said second electrostatic cleaning portion includes a second metal roller to be rotationally driven to contact said second cleaning member and includes a second cleaning blade contacted to the second metal roller.

4. An image forming apparatus according to claim 1, wherein said control portion decreases in a larger degree, with a higher humidity in an installation environment of a main assembly of said image forming apparatus, an amount of the decrease of the transfer voltage and an amount of the increase of the transfer voltage.

5. An image forming apparatus according to claim 1, wherein said control portion executes the adjusting mode during image formation.

6. An image forming apparatus according to claim 1, wherein said control portion executes the adjusting mode during non-image formation.

7. An image forming apparatus comprising:

an intermediary transfer belt;

a transfer member configured to transfer a toner image from said intermediary transfer belt onto a transfer material at a transfer portion;

a power supply configured to apply a transfer current to said transfer member;

a first cleaning member configured to contact with a surface of said intermediary transfer belt at a first cleaning portion to collect toner passed through the transfer portion, a first voltage having an identical polarity to a toner charge polarity being applied to said first cleaning member;

a second cleaning member configured to contact with the surface of said intermediary transfer belt at a second cleaning portion to collect the toner passed through the transfer portion, a second voltage having an opposite polarity to the toner charge polarity being applied to said second cleaning member;

a first detecting member configured to detect a first current passing through said first cleaning member;

a second detecting member configured to detect a second current passing through said second cleaning member;

a memory configured to store information about detection results of said first detecting member and said second detecting member; and a control portion, capable of executing an adjusting mode, configured to detect the first current and the second current using said first and second detecting members, respectively, and configured to adjust the transfer current on the basis of detection results of said first and said second detecting members and the information from said memory stored in a previous adjusting mode, the transfer current being adjusted to a lower current in a case of a first decrease amount being greater than a second decrease amount, and the transfer current being adjusted to a higher current in a case of the second decrease amount being greater than the first decrease amount, the first decrease amount being a value obtained by subtracting an absolute value of the first current detected in the adjusting mode from an absolute value of the first current detected in the previous adjusting mode, the second decrease amount being a value obtained by subtracting an absolute value of the second current detected in the adjusting mode from an absolute value of the second current detected in the previous adjusting mode.

8. An image forming apparatus according to claim 7, wherein said control portion executes the adjusting mode at a timing of every image formation of a predetermined number of sheets.

9. An image forming apparatus according to claim 7, wherein said first cleaning member is a first brush roller to be rotationally driven, and said first cleaning portion includes a first metal roller to be rotationally driven to contact said first cleaning member and includes a first cleaning blade contacted to the first metal roller, and wherein said second cleaning member is a second brush roller to be rotationally driven, and said second cleaning portion includes a second metal roller to be rotationally driven to contact said second cleaning member and includes a second cleaning blade contacted to the second metal roller.

10. An image forming apparatus according to claim 7, wherein said control portion decreases in a larger degree, with a higher humidity in an installation environment of a main assembly of said image forming apparatus, an amount of the decrease of the transfer current and an amount of the increase of the transfer current.

* * * * *